United States Patent [19]

Boothe

[11] 4,284,274

[45] Aug. 18, 1981

[54] EXERCISE DEVICE

[76] Inventor: Nathaniel L. Boothe, 7004 Batavia Way, Riverside, Calif. 92503

[21] Appl. No.: 101,260

[22] Filed: Dec. 7, 1979

[51] Int. Cl.[3] ..... A63B 21/28

[52] U.S. Cl. ..... 272/116; 272/143

[58] Field of Search ..... 272/116, 126, 93, 125, 272/1 R, 143; 273/1 R

[56] References Cited

U.S. PATENT DOCUMENTS

| | | | |
|---|---|---|---|
| 774,738 | 11/1904 | Chavez | 272/116 |
| 2,937,023 | 5/1960 | Seymour | 272/116 |
| 3,117,781 | 1/1964 | Vargo | 272/125 |
| 3,119,614 | 1/1964 | Berry | 272/125 |
| 3,129,940 | 4/1964 | Lauro | 272/116 |

*Primary Examiner*—Richard J. Johnson

*Attorney, Agent, or Firm*—Allan M. Shapiro

[57] ABSTRACT

Exercise device has a pair of bars each for the grip of one of the two persons exercising with the device and a tension member between bars. The tension member is of such length so that, when the two persons exercising are foot-to-foot and each grasping his respective bar, one of the exercisers is supine and the other is bent forward to a toe-touching angle. With each pulling on his respective bar and swiveling on the hip joints, the exercising persons alternate supine position.

7 Claims, 5 Drawing Figures

EXERCISE DEVICE

BACKGROUND OF THE INVENTION

This invention is directed to an exercise device particularly suitable for use by two persons so that each person pulls against the other and they each obtain the benefits of exercise.

With the change of society from an agricultural to an industrial society and with the change in the industrial society from a man-energized system to a machine-centered system, man has been getting less regular exercise. This is also true in the home where labor-saving devices have reduced the need for regular and more strenuous physical effort. As a result of this, man has not been getting regular exercise which is sufficiently strenuous to keep his body in a state of good physical fitness.

In recent years, it has been recognized that regular exercise of the proper degree of strenuousness on a regular basis and in supplement to the everyday activities is necessary for maintaining good physical condition and good health.

The fact that the majority of the citizens live in urban areas makes it more difficult for them to find space in which to exercise. Many systematic exercises and games require open areas, and, thus, are not as easily accessible to large numbers. An exercise which utilizes a large number of body muscles and which does not require open areas is necessary to satisfy the needs of most of the urban population. The device associated therewith must be simple and reliable in use, economical of purchase, and be of a nature for compact storage.

SUMMARY OF THE INVENTION

In order to aid in the understanding of this invention, it can be stated in essentially summary form that it is directed to an exercise device which has a pair of bars, one for each person exercising, and a tension member between bars so that the persons can pull against each other through the exercise employed.

It is, thus, an object of this invention to provide an exercise device wherein two persons can exercise many muscles by pulling against each other. It is another object to provide an exercise device wherein two persons can employ the device and pull against each other so that both have suitable exercise. It is another object to provide an exercise device which can be economically produced and readily stored so that it is available to those in urban situations where space is critical.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

DESCRIPTION OF THE PREFERRED EMBODIMENT

Figure 2:
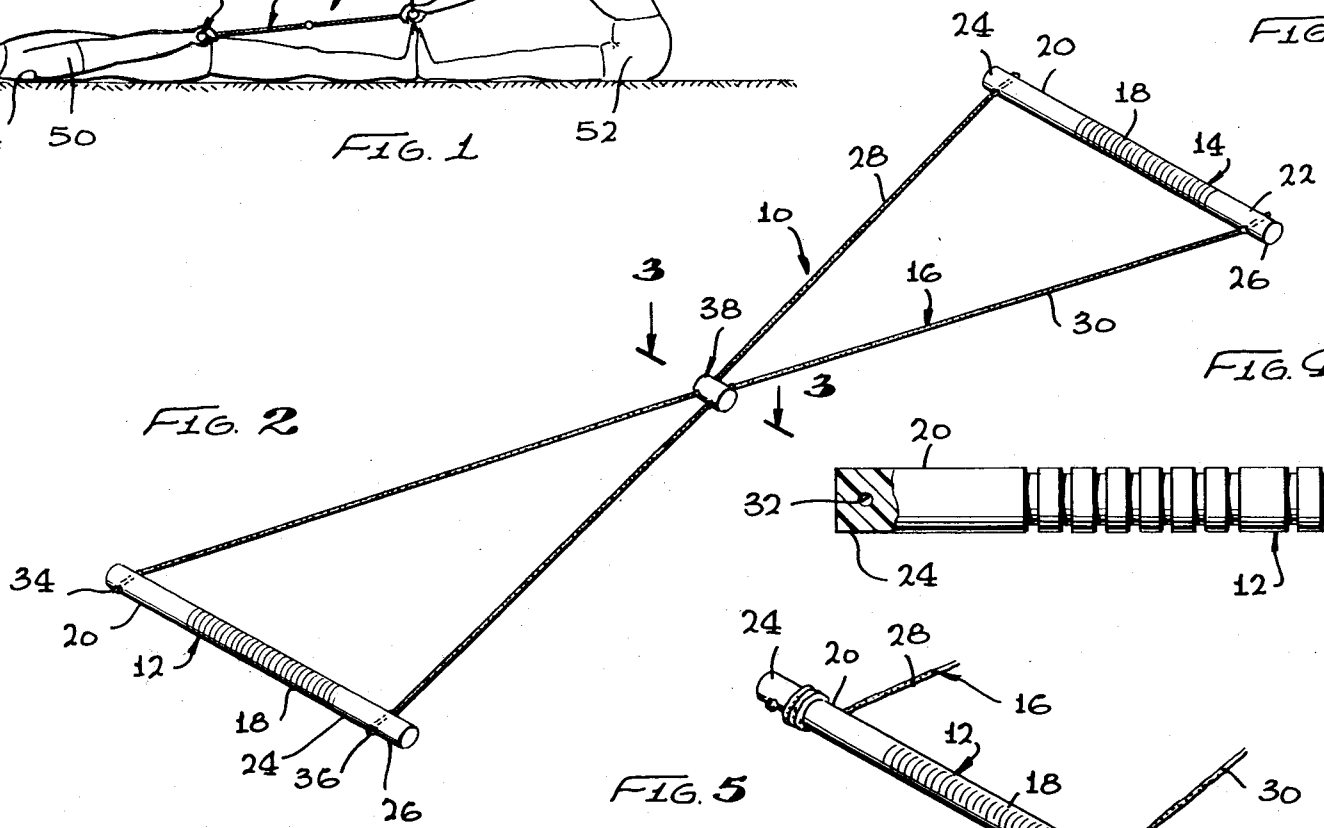
FIG. 2 is an enlarged isometric view of the exercise device.
Figure 1:
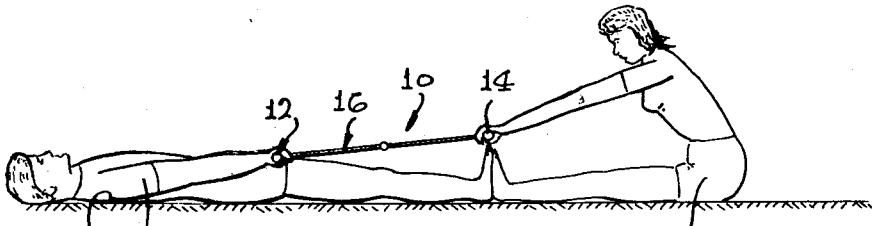
FIG. 1 is a side-elevational view of the exercise device of this invention, together with two persons using the exercise device.

The exercise device of this invention is generally indicated at 10 in FIGS. 1 and 2. It comprises first and second bars 12 and 14 connected by a tension member 16.

Each of the bars comprises a grip area 18 toward the center of the bar. The grip area illustrated has a plurality of rings formed around the bar which is otherwise a right cylindrical structure. Wood is a suitable material for the bar, but metal tube may be used, and some tough grades of synthetic polymer composition material are also suitable. The grip area 18 may be of enhanced graspability depending on the material. In the case of the metal tube, a tubular rubber hand grip can be placed on the grip area. In the case of a synthetic polymer composition material bar, a higher friction surface can be molded in or adhered thereto.

On the bar, outward of the grip area on both sides thereof is a windup area. The windup areas are indicated at 20 and 22. The windup areas areas are areas for the winding up of the cords of the tension member 16, as is described below. Outboard of the windup areas 20 and 22 are respectively tension member fastening areas 24 and 26.

Figure 4:
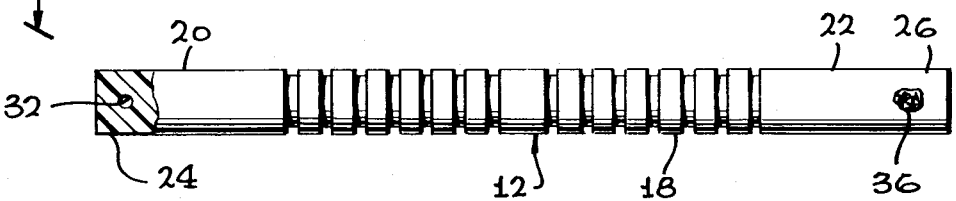
FIG. 4 is an enlarged view of one of the bars of the exercise device, with parts broken away and parts taken in section.

Tension member 16 is comprised of cords 28 and 30. Cords 28 and 30 are soft and flexible and have sufficient strength to inhibit breaking in tension during use of the exercise device. Each of the bars 12 and 14 is provided with cord-fastening means in the tension member fastening area. As is seen in FIG. 4 with respect to bar 12, a cord hole 32 is provided through the bar in tension member fastening area 24. A similar hole is provided at the other end of the bar in tension member fastening area 26. The cord 28 passes through hole 32 and carries thereon a knot 34, see FIG. 2, to prevent the cord 28 from slipping inwardly through the hole 32. A similar knot 36 is provided on the outside of bar 12 where cord 30 passes through the hole through the bar in fastening area 26. In this way, the two bars 12 and 14 are fastened so that they can occupy a maximum distance apart or space therebetween.

Figure 3:
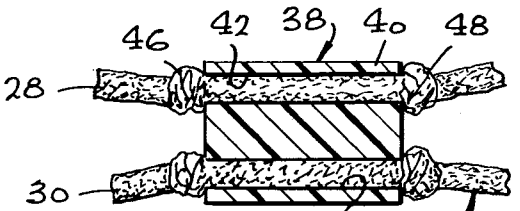
FIG. 3 is an enlarged section taken generally along the line 3—3 of FIG. 2, with parts broken away.

In order to provide diagonal stability to the exercise device 10, the cords 28 and 30 are secured together at the center by lock 38, see FIGS. 2 and 3. Lock 38 has a body 40 through which holes 42 and 44 are formed. Cords 28 and 30, respectively, pass through those holes and are knotted at each end, as by knots 46 and 48 in cord 28.

In use, there are two exercisers. In FIG. 1, the two exercisers are illustrated as man 50 and woman 52. The exercisers sit on the floor or other flat surface 54 in foot-to-foot position. Each grasps one of the bars, with the man grasping the bar 12 and the woman grasping bar 14, in the grip area. The distance between the bars of the exercise device is such that, with each of the exercisers pulling on his respective bar with the tension member taut, one of the exercisers rests supine on the floor; the other exerciser sits bending slightly forward with his fingers in line with his toes. Both of the exercisers have their arms stretched out and elbows locked, and each is pulling against the exercise device. The person sitting up pivots backwards on his hip joints while the other pivots up on his hip joints so that now the woman 52 is supine and the man is sitting up with his fingers in line with his toes. The exercise consists of each of the exercisers alternately moving from the situp to the supine position, also alternately with the other partner and at all times with the arms stretched and with tension on the exercise device. Such exercise will effect the calf, upper thigh, lower back, upper back, chest, shoulders, arms, neck, gluteous maximus, and stomach muscles. The effect can be easily felt by doing fifteen to twenty repetitions of the exercise with the exercise device. The exercise affects major areas of the body and the device 10 is preferably used three to four times a week for fifteen to twenty minutes a day to help maintain good physical fitness. The overall objective of the use of the exercise device 10 is to involve people in a physical fitness where good results can be achieved without fatigue. In addition, the exercise device can be used both as a warmup and as a cooling-out exerciser when respectively used prior to and subsequently to other sports activities. Such other sports activities include jogging, tennis, swimming, handball, soccer ball, baseball, football, karate, power lifting, and body building.

Figure 5:
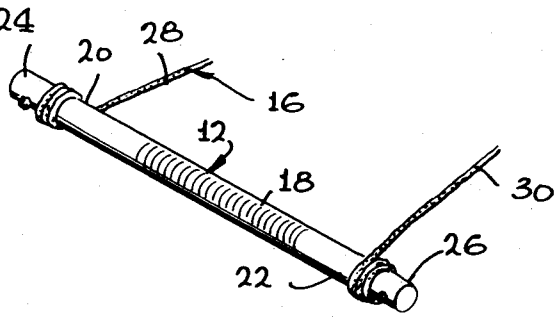
FIG. 5 is an isometric view of the exercise device, with parts broken away to show one of the bars in a shortened configuration of the exercise device.

The tension member 16 of exercise device 10 is sized so that the bars 12 and 14 are the maximum distance apart for the largest exercise device users. When smaller persons exercise with the device, there is need to shorten the effective length of tension member 16. This is accomplished by winding one of the cords one way around one of the bars in one direction and the other of the cords around the same bar in the opposite direction, both being wound on the windup area. This is illustrated in FIG. 5 where cord 28 is wound on the windup area 20 in the clockwise direction as viewed from that end of bar 18 while cord 30 is wound up on windup area 22 of bar 18 in the clockwise direction as seen from the other end of the bar. In this way, the effective length of the cords is reduced, and also the torque due to tension in the wound-up cords is balanced so that the bar 12 does not have any rotary force applied thereto by the cords when tension is applied to the tension member. Windup can be accomplished on both of the bars if a larger overall reduction in length is required. Since cords 28 and 30 are flexible, when exercise device 10 is not used, it may be folded into a small volume for convenient storage.

This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. An exercise device comprising:

first and second bars, each of said bars having a grip area dimensioned to be grasped by two human hands adjacent each other;

a tension member comprising first and second cords each having a respective pair of cord ends, said cords being secured at their said ends to said bars; and lock means for locking said cords together intermediate their ends for preventing relative longitudinal motion of said cords.

2. The exercise device of claim 1 wherein there is a windup area on each of said bars adjacent the ends thereof outboard of said grip area so that said cords can be wound onto said windup area on said bar without occupying said grip area.

3. The exercise device of claim 2 wherein a hole is located through said bar at each windup area through which said cords respectively pass and an enlargement is formed respectively on the ends of said cords beyond said holes to prevent said cords from passing through said holes.

4. The exercise device of claim 3 wherein said lock means comprises a lock body having first and second holes therethrough and said first and second cords respectively pass through said holes and said cords are secured with respect to said lock body to prevent relative longitudinal motion between said cords and to form a pair of triangles with said lock means at the apex of both said triangles and said bar respectively forming the base of each of said triangles.

5. The exercise device of claim 4 wherein a knot is formed in each of said cords on each side of said lock body to prevent relative motion of said cords with respect to said lock body.

6. The exercise device of claim 1 wherein said lock means comprises a lock body having first and second holes therethrough and said first and second cords respectively pass through said holes and said cords are secured with respect to said lock body to prevent relative longitudinal motion between said cords and to form a pair of triangles with said lock means at the apex of both said triangles and said bar respectively forming the base of each of said triangles.

7. The exercise device of claim 6 wherein a knot is formed in each of said cords on each side of said lock body to prevent relative motion of said cords with respect to said lock body.

* * * * *